US010383427B1

(12) United States Patent
Walker

(10) Patent No.: US 10,383,427 B1
(45) Date of Patent: Aug. 20, 2019

(54) BACKPACK SUPPORT DEVICE

(71) Applicant: Ralph Walker, Chesterfield, VA (US)

(72) Inventor: Ralph Walker, Chesterfield, VA (US)

( * ) Notice: Subject to any disclaimer, the term of this patent is extended or adjusted under 35 U.S.C. 154(b) by 0 days.

(21) Appl. No.: 15/949,133

(22) Filed: Apr. 10, 2018

(51) Int. Cl.
*A45F 3/10* (2006.01)

(52) U.S. Cl.
CPC ..... *A45F 3/10* (2013.01)

(58) Field of Classification Search
CPC ..... A45F 3/08; A45F 3/10; A45F 2003/125; A45F 3/04; A45F 3/047; B62B 5/0023; Y10S 224/9018; Y10S 224/907
USPC ..... 224/201
See application file for complete search history.

(56) References Cited

U.S. PATENT DOCUMENTS 2,050,822 A * 8/1936 Weber ..... A45F 3/10 224/201
3,563,431 A * 2/1971 Pletz ..... A45F 3/08 224/262
3,581,961 A * 6/1971 Owens ..... A45F 3/10 224/262
3,733,017 A * 5/1973 Pletz ..... A45F 3/08 224/235
3,860,157 A * 1/1975 Richards ..... A45F 3/08 224/153
3,881,644 A * 5/1975 Demaline ..... A45F 3/10 224/153
3,889,859 A * 6/1975 Joseph ..... A45F 3/08 224/235
3,938,718 A * 2/1976 Madison ..... A45F 3/10 224/262
3,946,916 A * 3/1976 Lawrence ..... A45F 3/10 224/262
4,040,548 A 8/1977 Guglielmo
5,564,612 A * 10/1996 Gregory ..... A45F 3/08 224/633
5,904,282 A * 5/1999 Gleason ..... A45F 3/08 224/263
D427,765 S 7/2000 Porter
7,021,508 B1 4/2006 Aston
7,052,080 B2 * 5/2006 Knight ..... A45F 4/02 224/155
7,931,178 B2 * 4/2011 Rome ..... A45F 3/04 206/315.3
8,172,117 B2 5/2012 Maggi
8,496,143 B1 * 7/2013 Joseph ..... A45F 3/14 224/201
8,556,280 B1 10/2013 Latimer
8,950,644 B2 2/2015 Gleason
(Continued)

*Primary Examiner* — Brian D Nash

(57) ABSTRACT

A backpack support device for coupling a backpack to a user includes a frame that is substantially rectangularly shaped. The frame comprises a pair of first rods and a plurality of second rods. Each first rod comprises a plurality of nested section so that the first rod is selectively extensible. Each first rod is arcuate proximate to a top of the first rod to define a shoulder hook that is configured to position over a respective shoulder of a user. Each second rod comprises a plurality of nested segments so that the second rod is selectively extensible. Each second rod is coupled to and extends between an associated pair of nested sections. A pair of fasteners is coupled singly proximate to the shoulder hooks on a back of the frame. The fasteners are configured to couple to shoulder straps of a backpack to couple the backpack to the frame.

17 Claims, 5 Drawing Sheets

(56) References Cited

U.S. PATENT DOCUMENTS

| | | | | |
|---|---|---|---|---|
| 2002/0043544 | A1* | 4/2002 | Caneba | A45C 13/262 224/584 |
| 2004/0178238 | A1* | 9/2004 | Le Gal | A45F 3/04 224/201 |
| 2004/0262343 | A1 | 12/2004 | Pratt | |
| 2007/0090137 | A1* | 4/2007 | Kim | A45F 3/047 224/153 |
| 2007/0090143 | A1* | 4/2007 | Clayton, III | A45F 3/10 224/637 |
| 2010/0032464 | A1* | 2/2010 | Gleason, Jr. | A45F 3/08 224/631 |

* cited by examiner

BACKPACK SUPPORT DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to backpack support devices and more particularly pertains to a new backpack support device for coupling a backpack to a user.

BRIEF SUMMARY OF THE INVENTION

An embodiment of the disclosure meets the needs presented above by generally comprising a frame that is substantially rectangularly shaped. The frame comprises a pair of first rods and a plurality of second rods. Each first rod comprises a plurality of nested section so that the first rod is selectively extensible. Each first rod is arcuate proximate to a top of the first rod to define a shoulder hook that is configured to position over a respective shoulder of a user. Each second rod comprises a plurality of nested segments so that the second rod is selectively extensible. Each second rod is coupled to and extends between an associated pair of nested sections. A pair of fasteners is coupled singly proximate to the shoulder hooks on a back of the frame. The fasteners are configured to couple to shoulder straps of a backpack to couple the backpack to the frame.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
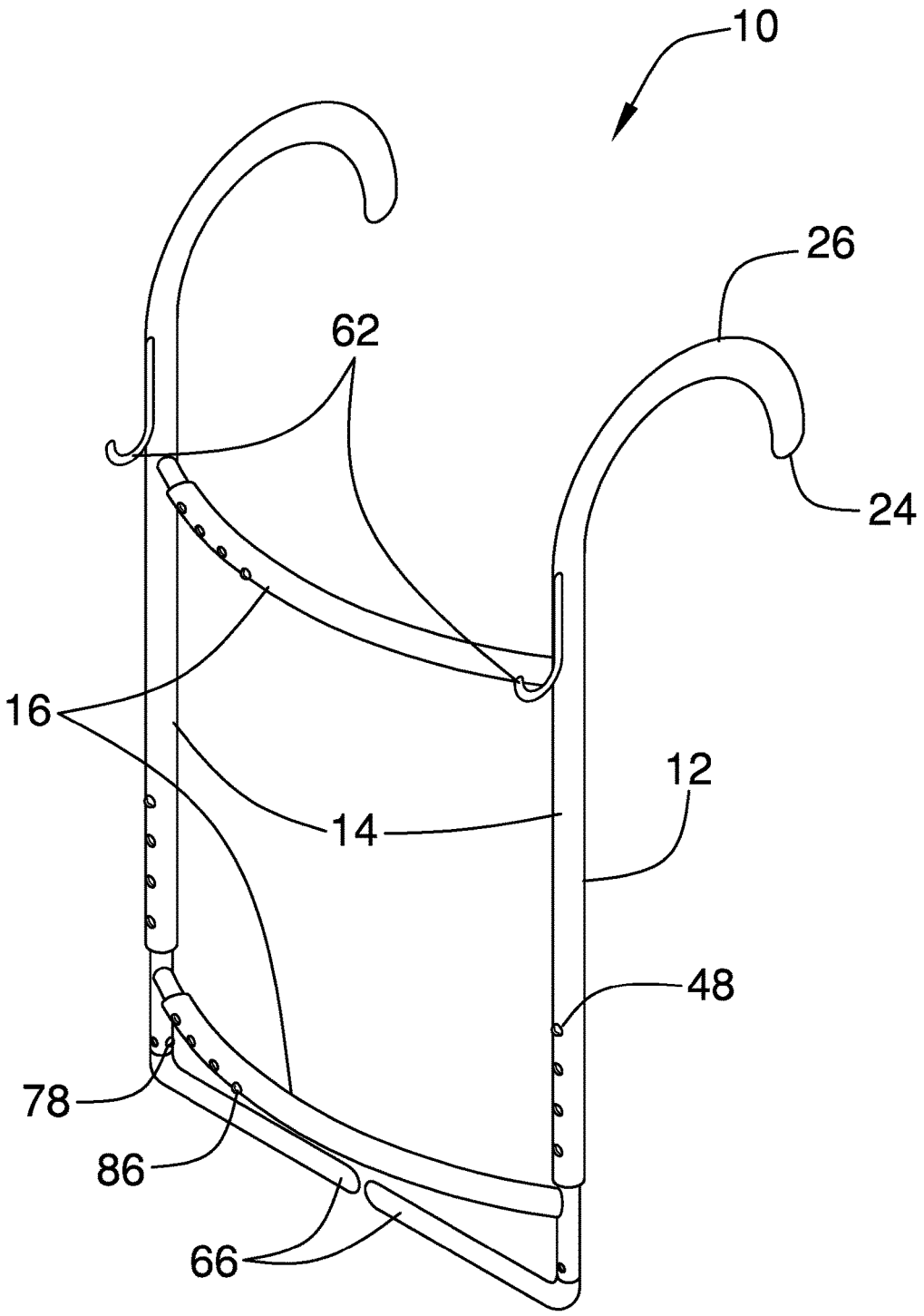
FIG. 1 is an isometric perspective view of a backpack support device according to an embodiment of the disclosure.

With reference now to the drawings, and in particular to FIGS. 1 through 5 thereof, a new backpack support device embodying the principles and concepts of an embodiment of the disclosure and generally designated by the reference numeral 10 will be described.

Figure 2:
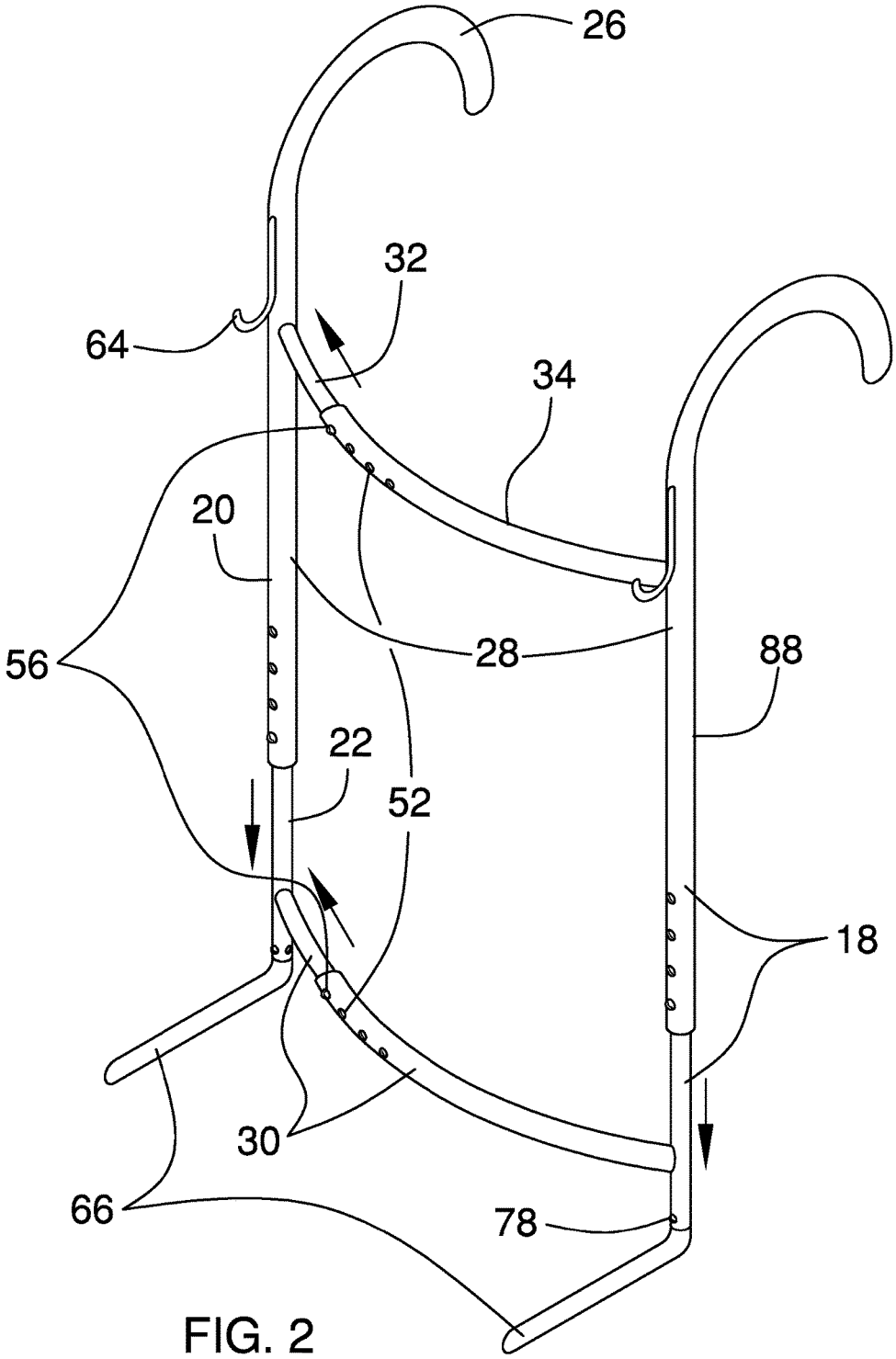
FIG. 2 is an isometric perspective view of an embodiment of the disclosure.
Figure 3:
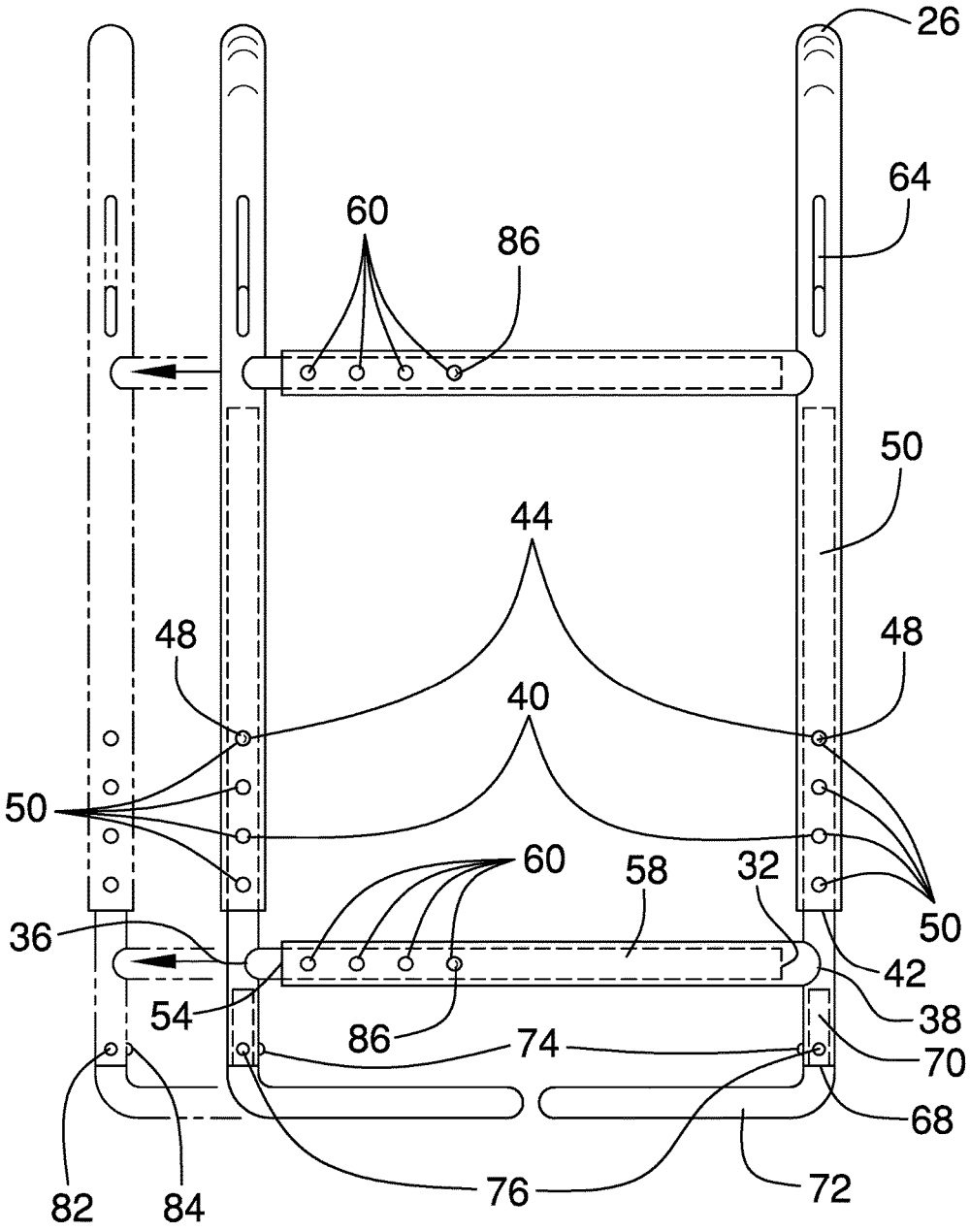
FIG. 3 is a back view of an embodiment of the disclosure.
Figure 4:
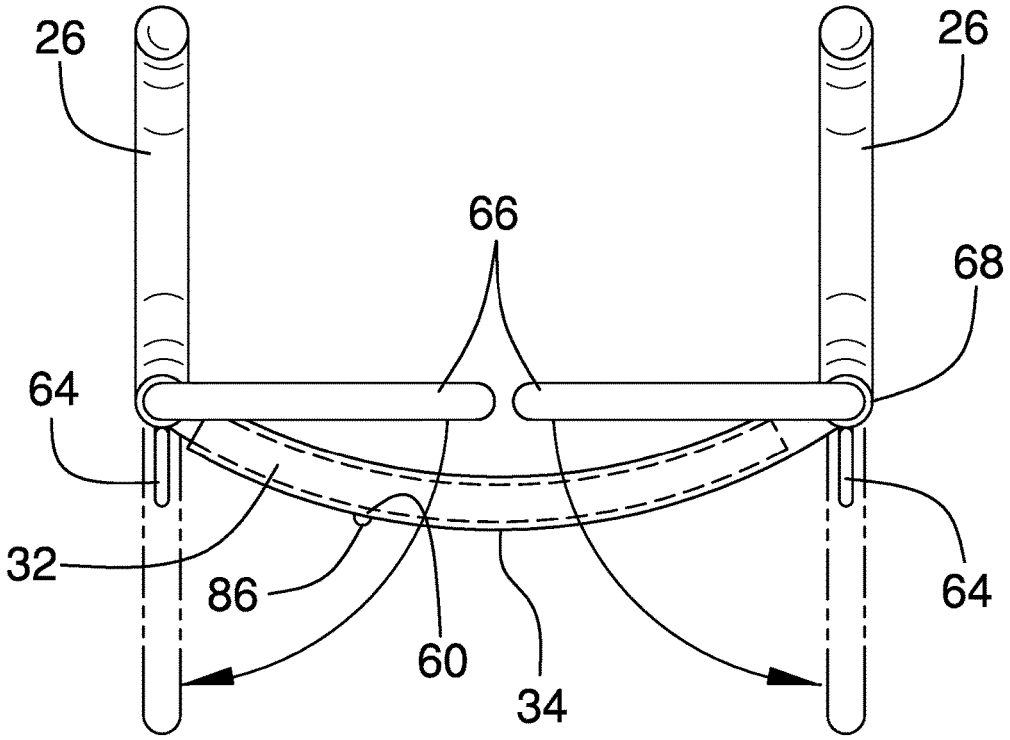
FIG. 4 is a bottom view of an embodiment of the disclosure.
Figure 5:
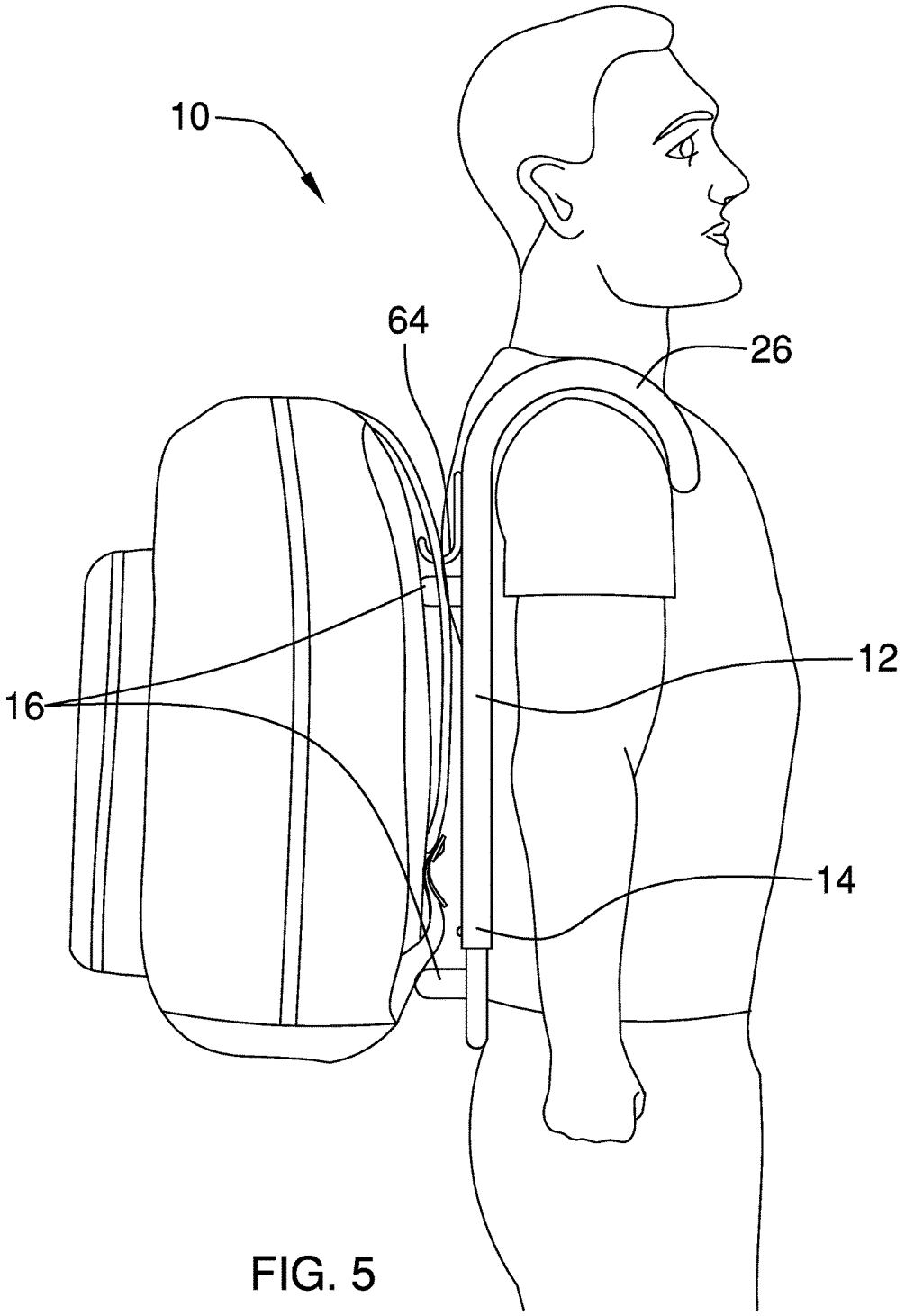
FIG. 5 is an in-use view of an embodiment of the disclosure.

As best illustrated in FIGS. 1 through 5, the backpack support device 10 generally comprises a frame 12 that is substantially rectangularly shaped, as shown in FIG. 3. The frame 12 comprises a pair of first rods 14 and a plurality of second rods 16. Each first rod 14 comprises a plurality of nested sections 18 so that the first rod 14 is selectively extensible to selectively fit a user. The plurality of nested sections 18 comprises an upper section 20 and a lower section 22, as shown in FIG. 2. Each first rod 14 is arcuate proximate to a top 24 of the first rod 14 to define a respective shoulder hook 26, as shown in FIG. 2. Each shoulder hook 26 is configured to position over a respective shoulder of the user to couple the frame 12 to the user, as shown in FIG. 5. The present invention also anticipates the shoulder hooks 26 being padded to increase the comfort of the shoulder hooks 26.

The plurality of second rods 16 comprises two second rods 16, as shown in FIG. 1. Each second rod 16 is coupled to and extends between an associated pair of nested sections 28. Each second rod 16 comprises a plurality of nested segments 30 so that the second rod 16 is selectively extensible to selectively fit the user. The plurality of nested segments 30 comprises an inner segment 32 and an outer segment 34, as shown in FIG. 2. The inner segment 32 and the outer segment 34 each have a first end, 36 and 38, respectively, that is coupled to a respective one of the associated pair of nested sections 28. The second rod 16 extends arcuately between the associated pair of nested sections 28 so that the second rod 16 protrudes from a back 88 of the frame 12, as shown in FIG. 4, to better fit the frame 12 to the user.

The first rods 14 and the second rods 16 are tubular to minimize a mass of the frame 12. The first rods 14 and the second rods 16 are circularly shaped when viewed longitudinally. The first rods 14 and the second rods 16 comprise aluminum or the like, again to minimize the mass of the frame 12 while maintaining the strength of the frame 12. The present invention also anticipates portions of the first rods 14 and portions of the second rods 16 being padded to increase the comfort of the frame 12.

Each of a pair of first couplers 40 is coupled to a respective upper section 20 proximate to a lower end 42 of the respective upper section 20. Each of a pair of second couplers 44 is coupled to a respective lower section 22 proximate to a centerpoint 46 of the respective lower section 22. This positioning of the second coupler 44 assures that sufficient length of the respective lower section 22 remains within the respective upper section 20 to maintain a structural integrity of the frame 12. The second couplers 44 are complementary to the first couplers 40. Each second coupler 44 is positioned to selectively couple to an associated first coupler 40 to couple the respective lower section 22 to the respective upper section 20.

Each second coupler 44 comprises an upright pin 48, as shown in FIG. 3. The upright pin 48 is spring-loaded. Each first coupler 40 comprises a plurality of holes 50 that extends from proximate to the lower end 42 of the respective upper section 20 toward the top 24 of the first rod 14. The plurality of holes 50 comprises four holes 50. The upright pin 48 is positioned to be depressed to slide the respective lower section 22 relative to the respective upper section 20, positioning the upright pin 48 to insert into a respective hole 50 to fixedly position the respective lower section 22 relative to the respective upper section 20.

Each of a pair of first connectors 52 is coupled to a respective outer segment 34 proximate to a second end 54 of the respective outer segment 34. Each of a pair of second connectors 56 is coupled to a respective inner segment 32 between a midpoint 58 and the first end 36 of the respective inner segment 32. This positioning of the second connector 56 assures that sufficient length of the respective inner segment 32 remains within the respective outer segment 34 to maintain the structural integrity of the frame 12. The second connectors 56 are complementary to the first connectors 52. Each second connector 56 is positioned to selectively couple to an associated first connector 52 to couple the respective inner segment 32 to the respective outer segment 34.

Each second connector 56 comprises a crossbar pin 86, as shown in FIG. 3. The crossbar pin 86 is spring-loaded. Each first connector 52 comprises a plurality of orifices 60 that extends from proximate to the lower end 42 of the respective outer segment 34 toward the top 24 of the first rod 14. The plurality of orifices 60 comprises four orifices 60. The crossbar pin 86 is positioned to be depressed to slide the respective inner segment 32 relative to the respective outer segment 34, positioning the crossbar pin 86 to insert into a respective orifice 60 to fixedly position the respective inner segment 32 relative to the respective outer segment 34.

Each of a pair of fasteners 62 is coupled to the back 88 of the frame 12 proximate to a respective shoulder hook 26, as shown in FIG. 1. Each fastener 62 is configured to selectively couple to a respective shoulder strap of a backpack to couple the backpack to the frame 12. Each fastener 62 comprises an upright hook 64 that is coupled to and extends from a respective first rod 14.

Each of a pair of third rods 66 is coupled to and extends from a bottom end 68 of a respective first rod 14. The third rods 66 extend perpendicularly from the back 88 of the frame 12. The third rods 66 are configured to support the frame 12, and the backpack that is coupled to the frame 12, on a substantially horizontal surface. Each third rod 66 is L-shaped to define a first section 70 and a second section 72 of the third rod 66. The first section 70 is inserted into the bottom end 68 of the respective first rod 14, as shown in FIG. 3. The third rod 66 is rotationally coupled to the respective first rod 14 so that the third rod 66 is configured to be rotated to selectively position the second section 72 substantially coplanarly with the frame 12, as shown in FIG. 4.

Each of a pair of first foot couplers 74 is coupled to a respective first rod 14 proximate to the bottom end 68 of the respective first rod 14. Each of a pair of second foot couplers 76 is coupled to the first section 70 of a respective third rod 66 proximate to the second section 72 of the respective third rod 66. The second foot couplers 76 are complementary to the first foot couplers 74. Each second foot coupler 76 is positioned to selectively couple to a respective first foot coupler 74 to couple the respective third rod 66 to the respective first rod 14.

Each second foot coupler 76 comprises a foot pin 78, as shown in FIG. 3. The foot pin 78 is spring-loaded. Each first foot coupler 74 comprises a plurality of apertures 80 that extends annularly around the respective first rod 14. The foot pin 78 is positioned to be depressed to rotate the respective third rod 66 relative to the respective first rod 14, positioning the foot pin 78 to insert into a respective aperture 80 to fixedly position the respective third rod 66 relative to the respective first rod 14.

The plurality of apertures 80 comprises a first aperture 82 and a second aperture 84. The foot pin 78 is positioned to insert into the first aperture 82 to fixedly position the second section 72 of the respective third rod 66 perpendicularly to the back 88 of the frame 12. The foot pin 78 is positioned to insert into the second aperture 84 to fixedly position the second section 72 of the respective third rod 66 substantially coplanar with the frame 12.

In use, the upright hooks 64 are configured to couple to a shoulder straps of the backpack to couple the backpack to the frame 12. The shoulder hooks 26 are configured to position over the shoulders of the user to couple the frame 12 to the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A backpack support device comprising:

a frame, said frame comprising:

a pair of first rods, each said first rod comprising a plurality of nested sections such that said first rod is selectively extensible, each said first rod being arcuate proximate to a top of said first rod defining a respective shoulder hook wherein each said shoulder hook is configured for positioning over a respective shoulder of a user for coupling said frame to the user, and a plurality of second rods, each said second rod comprising a plurality of nested segments such that said second rod is selectively extensible, each said second rod being coupled to and extending between an associated pair of said nested sections such that said frame is substantially rectangularly shaped;

a pair of fasteners, each said fastener being coupled to a back of said frame proximate to a respective said shoulder hook, each said fastener being configured for selectively coupling to a respective shoulder strap of a backpack for coupling the backpack to said frame;

said plurality of nested sections comprising an upper section and a lower section;

a pair of first couplers, each said first coupler being coupled to a respective said upper section proximate to a lower end of said respective said upper section; and a pair of second couplers, each said second coupler being coupled to a respective said lower section proximate to a centerpoint of said respective said lower section, said second couplers being complementary to said first couplers wherein each said second coupler is positioned for selectively coupling to an associated said first coupler for coupling said respective said lower section to said respective said upper section.

2. The device of claim 1, further including said first rods and second rods being tubular.

3. The device of claim 2, further including said first rods and second rods being circularly shaped when viewed longitudinally.

4. The device of claim 2, further including said first rods and second rods comprising aluminum.

5. The device of claim 1, further including said second rod extending arcuately between said associated pair of said nested sections such that said second rod protrudes from said back of said frame.

6. The device of claim 1, further including said plurality of second rods comprising two said second rods.

7. The device of claim 1, further including each said second coupler comprising an upright pin, said upright pin being spring-loaded, each said first coupler comprising a plurality of holes extending from proximate to said lower end of said respective said upper section toward said top of said first rod wherein said upright pin is positioned for depressing for sliding said respective said lower section relative to said respective said upper section positioning said upright pin for inserting into a respective said hole for fixedly positioning said respective said lower section relative to said respective said upper section.

8. The device of claim 7, further including said plurality of holes comprising four said holes.

9. The device of claim 1, further including each said fastener comprising an upright hook coupled to and extending from a respective said first rod.

10. A backpack support device comprising:

a frame, said frame comprising:

a pair of first rods, each said first rod comprising a plurality of nested sections such that said first rod is selectively extensible, each said first rod being arcuate proximate to a top of said first rod defining a respective shoulder hook wherein each said shoulder hook is configured for positioning over a respective shoulder of a user for coupling said frame to the user, and a plurality of second rods, each said second rod comprising a plurality of nested segments such that said second rod is selectively extensible, each said second rod being coupled to and extending between an associated pair of said nested sections such that said frame is substantially rectangularly shaped;

a pair of fasteners, each said fastener being coupled to a back of said frame proximate to a respective said shoulder hook, each said fastener being configured for selectively coupling to a respective shoulder strap of a backpack for coupling the backpack to said frame;

said plurality of nested segments comprising an inner segment and an outer segment, said inner segment and said outer segment each having a first end coupled to a respective one of said associated said pair of said nested sections;

a pair of first connectors, each said first connector being coupled to a respective said outer segment proximate to a second end of said respective said outer segment; and a pair of second connectors, each said second connector being coupled to a respective said inner segment between a midpoint and said first end of said respective said inner segment, said second connectors being complementary to said first connectors wherein each said second connector is positioned for selectively coupling to an associated said first connector for coupling said respective said inner segment to said respective said outer segment.

11. The device of claim 10, further including each said second connector comprising a crossbar pin, said crossbar pin being spring-loaded, each said first connector comprising a plurality of orifices extending from proximate to said lower end of said respective said outer segment toward said top of said first rod wherein said crossbar pin is positioned for depressing for sliding said respective said inner segment relative to said respective said outer segment positioning said crossbar pin for inserting into a respective said orifice for fixedly positioning said respective said inner segment relative to said respective said outer segment.

12. The device of claim 11, further including said plurality of orifices comprising four said orifices.

13. A backpack support device comprising:

a frame, said frame comprising:

a pair of first rods, each said first rod comprising a plurality of nested sections such that said first rod is selectively extensible, each said first rod being arcuate proximate to a top of said first rod defining a respective shoulder hook wherein each said shoulder hook is configured for positioning over a respective shoulder of a user for coupling said frame to the user, said first rods being tubular, said first rods being circularly shaped when viewed longitudinally, and a plurality of second rods, each said second rod comprising a plurality of nested segments such that said second rod is selectively extensible, each said second rod being coupled to and extending between an associated pair of said nested sections such that said frame is substantially rectangularly shaped, said second rods being tubular, said second rods being circularly shaped when viewed longitudinally; and a pair of fasteners, each said fastener being coupled to a back of said frame proximate to a respective said shoulder hook, each said fastener being configured for selectively coupling to a respective shoulder strap of a backpack for coupling the backpack to said frame; and a pair of third rods, each said third rod being coupled to and extending from a bottom end of a respective said first rod such that said third rods extend perpendicularly from said back of said frame wherein said third rods are configured for supporting said frame and the backpack coupled to said frame on a substantially horizontal surface.

14. The device of claim 13, further comprising:

each said third rod being L-shaped defining a first section and a second section of said third rod, said first section being inserted into said bottom end of said respective said first rod such that said third rod is rotationally coupled to said respective said first rod wherein said third rod is configured for being rotated such that said second section is substantially coplanar with said frame;

a pair of first foot couplers, each said first foot coupler being coupled to a respective said first rod proximate to said bottom end of said respective said first rod; and a pair of second foot couplers, each said second foot coupler being coupled to said first section of a respective said third rod proximate to said second section of said respective said third rod, said second foot couplers being complementary to said first foot couplers wherein each said second foot coupler is positioned for selectively coupling to a respective said first foot coupler for coupling said respective said third rod to said respective said first rod.

15. The device of claim 14, further including each said second foot coupler comprising a foot pin, said foot pin being spring-loaded, each said first foot coupler comprising a plurality of apertures extending annularly around said respective said first rod wherein said foot pin is positioned for depressing for rotating said respective said third rod relative to said respective said first rod positioning said foot pin for inserting into a respective said aperture for fixedly positioning said respective said third rod relative to said respective said first rod.

16. The device of claim 15, further including said plurality of apertures comprising a first aperture and a second aperture wherein said foot pin is positioned for inserting into said first aperture for fixedly positioning said second section of said respective said third rod perpendicularly to said back of said frame, wherein said foot pin is positioned for inserting into said second aperture for fixedly positioning said second section of said respective said third rod substantially coplanar with said frame.

17. The device of claim 1, further comprising:

said frame comprising:

said first rods being tubular, said first rods comprising aluminum, said first rods being circularly shaped when viewed longitudinally, and said plurality of second rods comprising two said second rods, said second rod extending arcuately between said associated pair of said nested sections such that said second rod protrudes from a back of said frame, said second rods being tubular, said second rods comprising aluminum, said second rods being circularly shaped when viewed longitudinally, said plurality of nested segments comprising an inner segment and an outer segment, said inner segment and said outer segment each having a first end coupled to a respective one of said associated said pair of said nested sections;

each said second coupler comprising an upright pin, said upright pin being spring-loaded, each said first coupler comprising a plurality of holes extending from proximate to said lower end of said respective said upper section toward said top of said first rod wherein said upright pin is positioned for depressing for sliding said respective said lower section relative to said respective said upper section positioning said upright pin for inserting into a respective said hole for fixedly positioning said respective said lower section relative to said respective said upper section, said plurality of holes comprising four said holes;

a pair of first connectors, each said first connector being coupled to a respective said outer segment proximate to a second end of said respective said outer segment;

a pair of second connectors, each said second connector being coupled to a respective said inner segment between a midpoint and said first end of said respective said inner segment, said second connectors being complementary to said first connectors wherein each said second connector is positioned for selectively coupling to an associated said first connector for coupling said respective said inner segment to said respective said outer segment, each said second connector comprising a crossbar pin, said crossbar pin being spring-loaded, each said first connector comprising a plurality of orifices extending from proximate to said lower end of said respective said outer segment toward said top of said first rod wherein said crossbar pin is positioned for depressing for sliding said respective said inner segment relative to said respective said outer segment positioning said crossbar pin for inserting into a respective said orifice for fixedly positioning said respective said inner segment relative to said respective said outer segment, said plurality of orifices comprising four said orifices;

each said fastener comprising an upright hook coupled to and extending from a respective said first rod;

a pair of third rods, each said third rod being coupled to and extending from a bottom end of a respective said first rod such that said third rods extend perpendicularly from said back of said frame wherein said third rods are configured for supporting said frame and the backpack coupled to said frame on a substantially horizontal surface, each said third rod being L-shaped defining a first section and a second section of said third rod, said first section being inserted into said bottom end of said respective said first rod such that said third rod is rotationally coupled to said respective said first rod wherein said third rod is configured for being rotated such that said second section is substantially coplanar with said frame;

a pair of first foot couplers, each said first foot coupler being coupled to a respective said first rod proximate to said bottom end of said respective said first rod; and a pair of second foot couplers, each said second foot coupler being coupled to said first section of a respective said third rod proximate to said second section of said respective said third rod, said second foot couplers being complementary to said first foot couplers wherein each said second foot coupler is positioned for selectively coupling to a respective said first foot coupler for coupling said respective said third rod to said respective said first rod, each said second foot coupler comprising a foot pin, said foot pin being spring-loaded, each said first foot coupler comprising a plurality of apertures extending annularly around said respective said first rod wherein said foot pin is positioned for depressing for rotating said respective said third rod relative to said respective said first rod positioning said foot pin for inserting into a respective said aperture for fixedly positioning said respective said third rod relative to said respective said first rod, said plurality of apertures comprising a first aperture and a second aperture wherein said foot pin is positioned for inserting into said first aperture for fixedly positioning said second section of said respective said third rod perpendicularly to said back of said frame, wherein said foot pin is positioned for inserting into said second aperture for fixedly positioning said second section of said respective said third rod substantially coplanar with said frame.

* * * * *